United States Patent [19]

Pepper

[11] 4,021,145

[45] May 3, 1977

[54] SUMP PUMP ASSEMBLY

[75] Inventor: Kenneth V. Pepper, Davison, Mich.

[73] Assignee: Genova, Inc., Davison, Mich.

[22] Filed: Jan. 2, 1976

[21] Appl. No.: 646,186

[52] U.S. Cl. ..... 417/40; 415/201

[51] Int. Cl.[2] ..... F04B 49/00; F01D 21/00; F01B 1/00

[58] Field of Search ..... 417/40, 360; 415/201

[56] References Cited

UNITED STATES PATENTS

| | | | |
|---|---|---|---|
| 1,883,266 | 10/1932 | Yoder | 417/40 |
| 2,251,807 | 8/1941 | Ruthman | 417/424 |
| 2,309,670 | 2/1943 | Ruthman | 417/424 |
| 2,525,370 | 10/1950 | Pollak | 417/424 |
| 2,918,016 | 12/1959 | Olson | 417/40 |
| 3,227,087 | 1/1966 | Albee et al. | 415/201 |
| 3,335,668 | 8/1967 | Thon | 415/201 |
| 3,407,739 | 10/1968 | Myers | 415/201 |
| 3,779,670 | 12/1973 | Crisafolli | 417/231 |

*Primary Examiner*—William L. Freeh
*Attorney, Agent, or Firm*—Olsen and Stephenson

[57] ABSTRACT

A modular sump pump assembly is disclosed that consists of three components—a base module, a power module and a switch module. The base module includes the pump casing and is adapted to be connected to the piping that is utilized for discharging the liquid from the sump. The power module, which comprises the pump impeller, the motor, the connecting drive shaft and related parts can be inserted at the pump impeller end into and removed from the base module by means of a bayonet-type joint so that servicing of the power module can be performed merely by twisting the power module relative to the base module to disconnect the bayonet-type joint, after which the power module can be lifted from the sump. The switch module is connected to the power module so that it also can be serviced merely by removal of the power module from the base module and then, if desired, disconnected from the power module.

8 Claims, 12 Drawing Figures

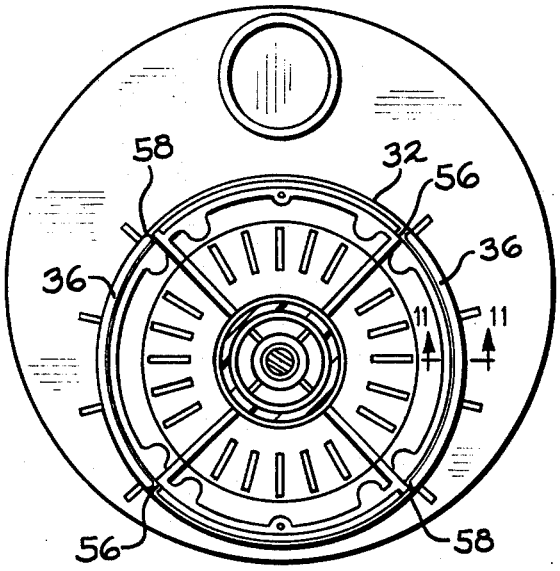
FIG. 4
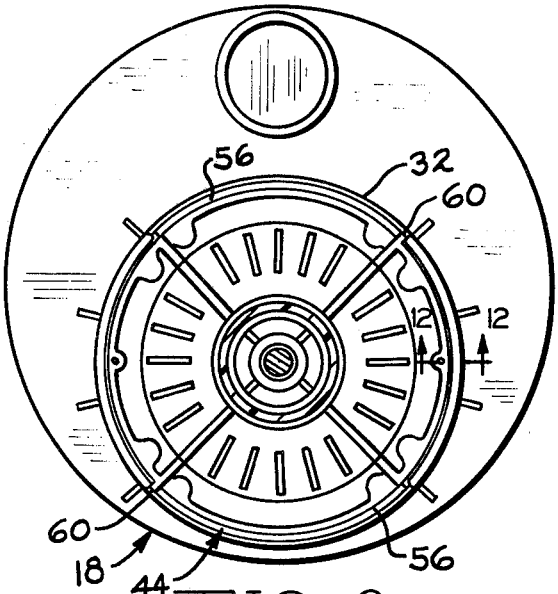
FIG. 6
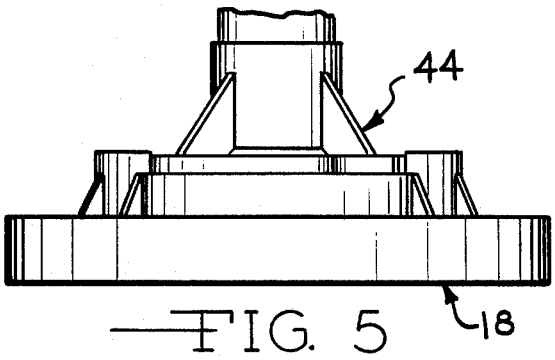
FIG. 5
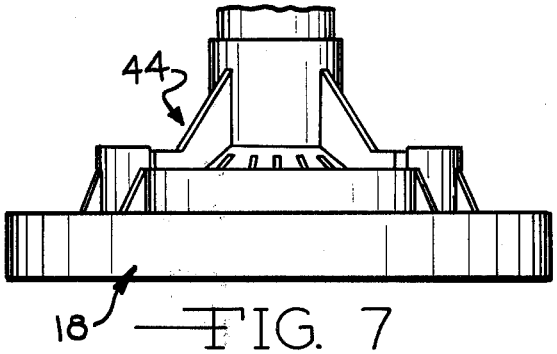
FIG. 7
FIG. 8
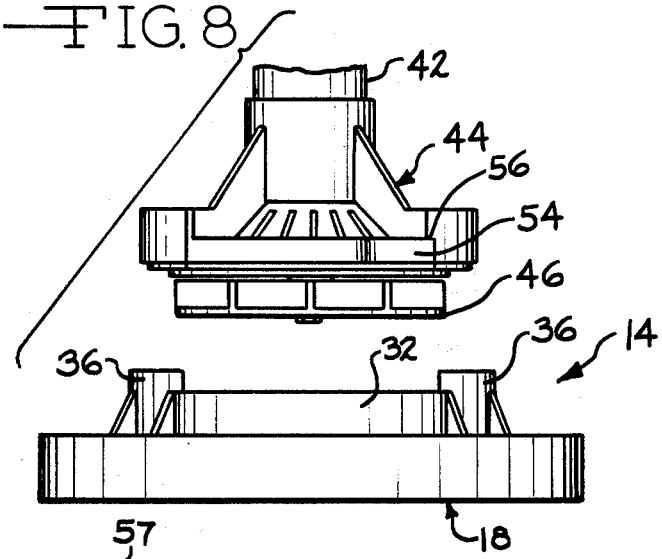
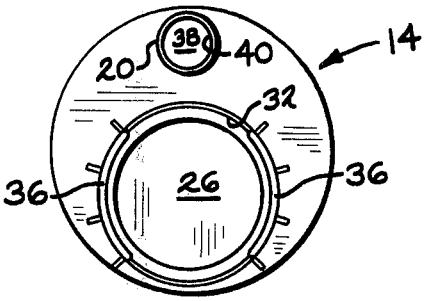
FIG. 9
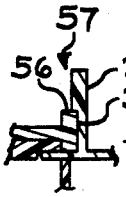
FIG. 11
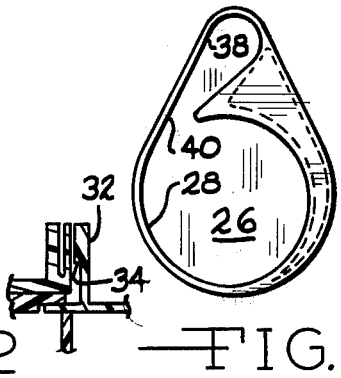
FIG. 12
FIG. 10

SUMP PUMP ASSEMBLY

REFERENCE TO RELATED APPLICATION

Reference is made to pending application Ser. No. 498,599, filed Aug. 19, 1974 in the name of Kenneth V. Pepper, entitled "Switch Assembly" now U.S. Pat. No. 3,911,770, patented Mar. 16, 1976.

BACKGROUND OF THE INVENTION

The present invention relates to sump pumps or similar pumps which are used to remove accumulated liquid from a sump or similar chamber.

In the past, when service or repair of a sump pump has been required, it has been necessary for the serviceman to get down into the sump with his tools to disconnect and remove the pump, switches, piping and the like. Generally, this is an arduous, time-consuming and unpleasant task, and there has been a long-felt need for improvement that will overcome this problem.

SUMMARY OF THE INVENTION

The present invention has overcome the inadequacies of the prior art and provides a sump pump assembly wherein all of the moving and serviceable parts of the pump assembly can readily be removed from the sump without first disconnecting the discharge piping from the pump.

To accomplish this result the pump assembly has been made in modular form with a base module that can be permanently connected to the discharge piping and that is free of parts that require servicing or repair. A power module is provided which can be inserted into or removed from the base module from a position outside the sump merely by twisting the power module relative to the base module. A switch module is also provided which is connected to the power module so that it can also be removed readily merely by removal of the power module from the base module.

According to one form of the invention, a sump pump assembly is provided for pumping liquid from a sump or other chamber comprising a base module and a power module, said base module including a base or first pump housing member adapted to be secured to discharge piping and defining a pump casing for the pump impeller with an outlet construction for communication with the discharge piping. The power module includes a support member, which in this embodiment of the invention is in the form of a conduit, and a rotary pump impeller is mounted on the lower end of a drive shaft. A motor is mounted on the upper end of the support member and is drivingly connected to the impeller of the pump by the drive shaft. The impeller of the pump is enclosed on its upper side by a second pump housing member which telescopes into the first pump housing member and can be retained therein by a joint of the bayonet-type. The joint is arranged so that when the pump motor is running the torque applied to the drive shaft will urge the bayonet joint to its closed position assuring that the modular parts will remain securely retained together. A switch module of the type disclosed in the aforesaid U.S. Pat. No. 3,911,770 can be mounted on the support member so that the switch module and the power module can readily be removed from the sump merely by twisting the support member about its axis opposite to the direction of turning of the pump motor, thereby releasing the joint between the power module and the base module, allowing the power module and the switch module to be removed as a unit from the sump.

Thus, it is among the objects of the present invention to provide an improved sump pump assembly which is characterized by the ease in which the moving parts thereof can be removed from the sump for servicing and repair purposes.

Other objects of this invention will appear in the following description and appended claims, reference being had to the accompanying drawings forming a part of this specification wherein like reference characters designate corresponding parts in the several views.

BRIEF DESCRIPTION OF THE DRAWINGS

FIG. 4 is a sectional view taken on the line 4—4 of FIG. 3, showing the power module secured in the base module;

FIG. 5 is a fragmentary elevational view of the invention in the position shown in FIG. 4;

FIG. 6 is a sectional view similar to FIG. 4, but showing the power module in a twisted position preparatory for removal from the base module;

FIG. 7 is a fragmentary elevational view of the invention in the position shown in FIG. 6;

FIG. 8 is an exploded fragmentary elevational view of the invention, showing the power module removed from the base module;

FIG. 9 is a top plan view in reduced scale of the base module with the power module removed;

FIG. 10 is a top plan view of the involute pump casing with parts removed, taken on the line 10—10 of FIG. 3;

FIG. 11 is a fragmentary section taken on the line 11—11 of FIG. 4 showing the joint between the first and second pump housing members in a secured position; and FIG. 12 is a fragmentary section taken on the line 12—12 of FIG. 6 showing the joint between the first and second pump housing members in a released position.

DESCRIPTION OF THE PREFERRED EMBODIMENT

Figure 1:
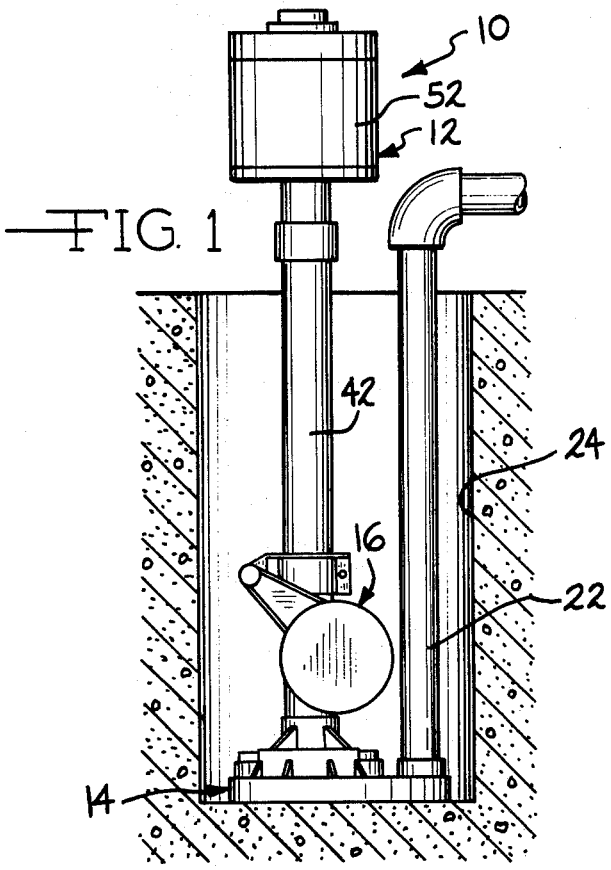
FIG. 1 is an elevational view of a sump pump assembly embodying the present invention installed in a sump and connected to conventional piping.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The sump pump assembly 10 comprises the power module 12, the base module 14 and the switch module 16.

The base module 14 has no moving parts and includes a first pump housing member 18 having an outlet means or fitting 20 adapted to be secured to the discharge piping 22 which extends into the sump 24. The first pump housing member 18 has a bottom wall 26 and a generally involute-shaped side wall 28 projecting upward from the bottom wall 26 and cooperating with the bottom wall 26 to define a casing 30. Mounted on and extending upward from the casing 30 is a generally cylindrical-shaped wall 32 which has circumferentially extending segmental shoulders 34 for a purpose to be described. The shoulders 34 are located only in the diametrically opposed arcuate segments 36 of the cylindrical wall 32.

As can be seen best in FIG. 10, the generally involute-shaped side wall 28 has its enlarged end in communication with a discharge compartment 38 so that water can be pumped from the enlarged end 40 of the casing 30 into the discharge compartment 38 from which it can flow to the discharge piping 24 via the outlet port 40.

The power module 12 includes a support member or conduit 42 preferably made out of the thermoplastic tubular material and which has mounted on its lower end the second pump housing member 44. A rotary pump impeller 46 is carried on the lower end of the support member 42 by a drive shaft 50 with which the impeller 46 can rotate. A motor 52 is mounted on the upper end of the support member 42 and is drivingly connected to the impeller 46 by means of the shaft 50.

The second pump housing member 44 has a generally cylindrical-shaped wall 54 with diametrically opposed upwardly facing shoulders 56, which in the positions shown in FIG. 4 are located under the shoulder portions 34 of the cylindrical wall 32 of the first pump housing member 18. By virtue of this arrangement they define in effect a bayonet-type joint 57 which allows the first pump housing member 18 to receive the second pump housing member 44 when the latter is introduced vertically or telescoped into the former, and thereafter, the second pump housing member 44 can be twisted 90° clockwise so that its shoulders 56 are located under the associated shoulders 34 of the first pump housing member 18, thereby securing the two pump housing members together. The extent of travel of the two housing members relative to one another in the clockwise direction is limited by the stop members located at 58, as can be seen best in FIG. 4. When the first and second pump housing members 18 and 34 are turned in the opposite direction relative to one another, the extent of travel is limited by the associated stop members located at 60, as can be seen best in FIG. 6.

The second pump housing member 44 has inlet means 62 whereby water within the sump 24 can be drawn to the inner radius of the pump impeller 46 for subsequent discharge outwardly through the involute casing 30 and thereafter out the outlet port 40 when the impeller 46 is rotated by the pump motor 52. The second pump housing member 44 also serves to support the shaft bearing 64 for the drive shaft 50.

Figure 2:
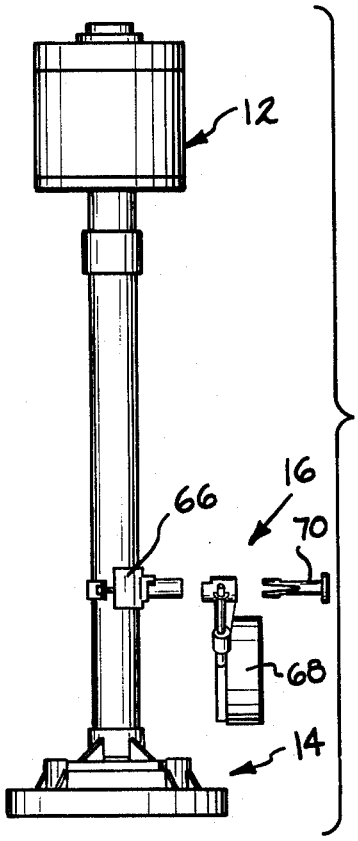
FIG. 2 is an exploded view of the power module and the switch module disconnected from the base module and removed from the sump.
Figure 3:
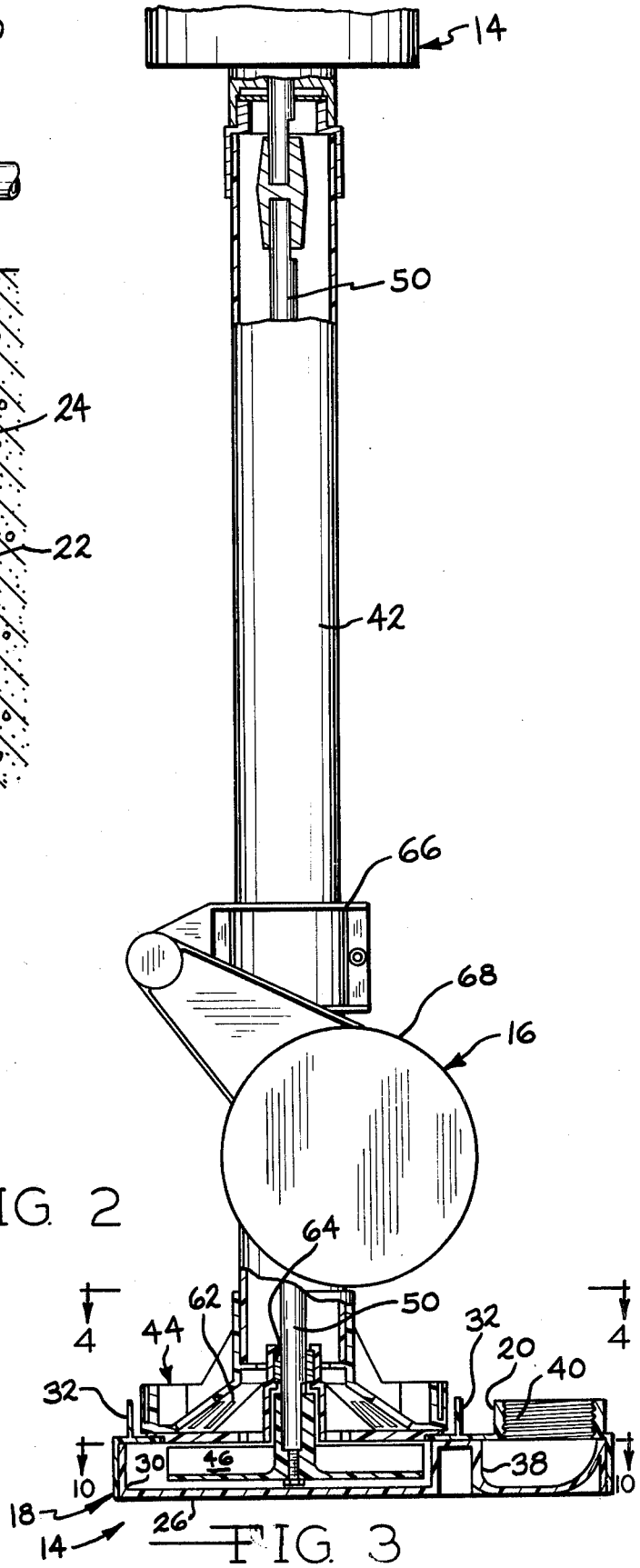
FIG. 3 is an enlarged elevation, partially in vertical section showing internal details of the invention.

From the foregoing description it will be understood that the water from within the sump 24 can readily be discharged through the discharge piping 22 when the pump motor 52 is energized and is turning the pump impeller 46. Control of operation of the pump motor 52 is achieved by means of the switch module 16 which is mounted on the support member 42 by means of the bracket 66 on which the float actuating mechanism 68 is pivotally mounted. As can be seen in FIG. 2, the pivotal connection for the float actuating mechanism 68 on the bracket 66 is achieved by utilizing the removable pivot pin 70. For a more detailed description of the float actuating mechanism 68, reference is made of said U.S. Pat. No. 3,911,770.

When it is desired to service either the switch module 16 or any of the moving components of the power module 12, this can readily be accomplished merely by twisting the power module 12 about the axis of the pump impeller 46 to a position wherein the second pump housing member 44 can be lifted upwardly away from the first pump housing member 18. To assure that the bayonet-type joint 57 which is provided between these housing members remains in the secured position, the stop members 58 and 60 are arranged so that the torque of the pump motor 52 will urge the pump housing members 18 and 44 to the secured position shown in FIGS. 4 and 5.

It is claimed:

1. A sump pump assembly for pumping liquid from a sump into discharge piping comprising a base module and a power module, said base module including a first pump housing member having outlet means and being adapted to be secured to said discharge piping with said outlet means in communication with said discharge piping, said power module including a support member with a rotary pump impeller mounted on its lower end, a second pump housing member with inlet means adapted to be in communication with the sump, a motor mounted on the upper end of the support member and a shaft extending through the support member drivingly connecting the motor to the pump impeller, the first and second pump housing members defining a free-sliding joint for securing the power module to the base module with the pump impeller in operative position within the housing members and for releasing the power module from the base module when power module is twisted freely in one direction about the axis of said pump impeller, said joint including circumferentially extending shoulders in free-sliding engagement for interlocking said housing members only against relative axial displacement and cooperating stop members associated with said shoulders for limiting the extent of free twisting that can occur in said one direction, said one direction being opposite to the operative direction of turning of said pump impeller, said housing members and said pump impeller forming a pump having said inlet means for receiving liquid from said sump and said outlet means for discharge of the liquid from the sump to said piping.

2. The sump pump assembly that is defined in claim 1, which comprises a switch module including a bracket mounted on said support member and a float actuating mechanism for intermittently starting and stopping said motor, said float actuating mechanism being releasably connected to said bracket solely by a removable pivot pin, said switch module being mounted on said support member so that it can be removed from said sump together with said power module when the power module is disconnected from said base module.

3. The sump pump assembly that is defined in claim 1, wherein said second pump housing member has mounted therein a shaft bearing, and said shaft is supported at its lower end in said bearing.

4. The sump pump assembly that is defined in claim 1, wherein said support member is a conduit of thermoplastic material, and said first and second housing members are made of thermoplastic material.

5. The sump pump assembly that is defined in claim 1, wherein said first housing member has a bottom wall and a generally involuteshaped side wall projecting upward from said bottom wall, said side and bottom walls cooperating in defining a casing for said pump impeller, said first housing member having a generally cylindrical-shaped wall extending upward from said casing, said second pump housing member having a cylindrical wall extending downward for seating in telescoped relation with respect to said casing cylindrical wall to defing therewith said joint, said cylindrical walls having said shoulders to secure the telescoped walls together when the power module is twisted from the seated position of the second pump housing member in said one direction about the axis of the pump impeller.

6. The sump pump assembly that is defined in claim 5, wherein said motor is operable to turn said pump impeller in its operative direction so that the torque of the motor will urge the stop members together.

7. The sump pump assembly that is defined in claim 6, wherein said cylindrical walls have second cooperating stop members for limiting the extent of twisting that can occur of said power module in the other direction to a position wherein said cylindrical walls can be separated axially for removing said power module from said base module.

8. A sump pump assembly for pumping liquid from a sump into discharge piping comprising a base module and a power module, said base module including a first pump housing member having outlet means and being adapted to be secured to said discharge piping with said outlet means in communication with said discharge piping, said power module including a support member with a rotary pump impeller mounted on its lower end, a second pump housing member with inlet means adapted to be in communication with the sump, a motor mounted on the upper end of the support member and a shaft extending through the support member drivingly connecting the motor to the pump impeller, the first and second pump housing members defining a free-sliding joint for securing the power module to the base module with the pump impeller in operative position within the housing members and for releasing the power module from the base module when the power module is twisted freely in one direction about the axis of said pump impeller, said housing members and said pump impeller forming a pump having said inlet means for receiving liquid from said sump and said outlet means for discharge of the liquid from the sump to said piping, said first housing member having a flat bottom wall for seating on the bottom of said sump, a generally involute-shaped side wall projecting upward from said bottom wall forming a casing enclosing the outer radial periphery of said pump impeller, and a discharge compartment on the external side of said casing in communication with the enlarged end thereof, said discharge compartment having an upwardly opening fitting defining an outlet port for communication with said piping, said fitting rigidly connecting said piping to said first housing member.

* * * * *